United States Patent [19]

Patterson et al.

[11] Patent Number: 4,909,322

[45] Date of Patent: Mar. 20, 1990

[54] CASING CENTRALIZER

[75] Inventors: Ronnie G. Patterson, Sugar Land; Hedayat H. Hassanzadeh, Houston, both of Tex.

[73] Assignee: Davis-Lynch, Inc., Houston, Tex.

[21] Appl. No.: 343,822

[22] Filed: Apr. 26, 1989

[51] Int. Cl.[4] ..... E21B 17/10

[52] U.S. Cl. ..... 166/241; 175/325

[58] Field of Search ..... 166/241, 170, 172, 173, 166/175; 175/325

[56] References Cited

U.S. PATENT DOCUMENTS

| | | | |
|---|---|---|---|
| 3,356,147 | 12/1967 | Dreyfuss | 166/241 |
| 4,042,022 | 8/1977 | Wills et al. | 166/241 |
| 4,077,470 | 3/1978 | Dane | 166/241 |
| 4,143,713 | 3/1979 | Kreft | 166/241 |
| 4,269,269 | 5/1981 | Wilson | 166/241 |
| 4,520,869 | 6/1985 | Svenson | 166/241 |
| 4,651,823 | 3/1987 | Spikes | 166/241 |

FOREIGN PATENT DOCUMENTS

| | | | |
|---|---|---|---|
| 2179079 | 2/1987 | United Kingdom | 166/241 |

*Primary Examiner*—Bruce M. Kisliuk

*Attorney, Agent, or Firm*—Vaden, Eickenroht, Thompson & Boulware

[57] ABSTRACT

There is disclosed a casing centralizer which comprises a pair of longitudinally spaced collars adapted to be assembled about the casing, and bow springs which extend longitudinally between the collars. The ends of the bow springs are secured to the collars by means of outwardly bent portions at the ends of the bow springs which are adapted to fit within openings in the collars, and a tab on one side of each collar opening which extends inwardly from the inner surface of the collar and passes through an opening in the end of the bow spring adjacent its outwardly bent portion, whereby each tab may be bent over the inner surface of the bent portion at the end of the bow spring so as to hold the outer surface of the end of the bow spring against the inner surface of the collar.

5 Claims, 3 Drawing Sheets

CASING CENTRALIZER

This invention relates generally to a casing centralizer of the type in which a pair of longitudinally spaced collars are adapted to be assembled about the casing, and bow springs extend longitudinally between. More particularly, it relates to improvements in centralizers of this type wherein the opposite ends of the bow springs are non-weldably secured to the collars.

As is well known in the art, the collars of such centralizers normally comprise hingedly connected, arcuate sections which may be opened up for assembly about the casing and then latched to one another in close fitting relation thereabout. The bow springs comprise relatively thin, flexible strips of metal which are bowed outwardly intermediate their ends so as to tightly engage the bore of a well. More particularly, the bow springs are equally spaced apart so as to hold the casing in a generally centered position within the well bore to insure that the column of cement forced into the annulus between the casing and well bore is of substantially uniform thickness. The collars fit closely about the casing, but are free to slide therealong, so that, when the central portions of the bow springs are inwardly compressed by engagement with the well bore, their ends move the collars away from one another.

Although the ends of the bow springs of some centralizers are welded to the collars, it is often preferred to secure them without welding, so that the collars and bow springs may be stored and shipped in disassembled relation, and then assembled to secure the ends of the bow springs to the collar in the field without the need for welding. This not only permits them to be stored and shipped in relatively small spaces, but also permits them to be stocked in more versatile combinations since bow springs of different sizes may be assembled with the same collars and vice versa.

U.S. Pat. Nos. 3,356,174 and 4,042,022 show centralizers of this type in which the collars are formed with openings to receive outwardly bent portions on the ends of the bow springs, and tabs on one or both sides of the openings which extend inwardly from the inner surfaces of the collars, at one side of each opening, so that, when the bent portions are so received, the tabs may be bent over the outer surfaces of the bent portions to hold the outer surfaces of the ends of the springs against the inner surfaces of the collars, and thus hold the bent portions within the collar openings to secure the ends of the bow springs to the collars. Since the ends of the bow springs are on the inside of the collars, inward compression of the bow springs moves their ends even more tightly against the collars.

Although preferable in many respects to centralizers having other non-welded arrangements for securing the ends of the bow springs to the collars, the bent portions of the bow springs of these centralizers may nevertheless be pulled out of the collar openings if the tabs are bent away from the inner surfaces of the bent portions, as might occur, for example, when the bow springs are restrained from vertical movement with the collars during reciprocation of the casing within the well bore. It is therefore an object of this invention to provide a casing centralizer of this type wherein the ends of the bow springs are more permanently secured to the collars, and, more particularly, in which outwardly bent portions on the ends of the springs are held within openings in the collars in such a manner as to reduce the likelihood of their being pulled loose from the collars.

This and other objects are accomplished, in accordance with the illustrated embodiments of the invention, by a centralizer of this type wherein each collar has openings formed therein and a tab on one side of each opening which is extendable inwardly from the inner surface of the collar, and each bow spring has an outwardly bent portion at each end thereof adapted to fit within a collar opening and an opening therein on one side of the bent portion through which the tab may pass. More particularly, as in the above described centralizers, the tab is bendable over the inner surface of the bent portion of the bow spring so as to hold the outer surface of the end of the bow spring tightly against the inner surface of the collar. However, as will be appreciated, particularly from the detailed description to follow, extension of the tabs through the openings in the ends of the bow spring prevents the bow spring from being pulled loose of the collar even if the tabs are partially bent back such that the bent portions become free of the collar openings.

Preferably, each such collar has a pair of laterally spaced openings formed therein and a tab on the side of each opening, and each bow spring has a pair of laterally spaced outwardly bent portions at each end which are adapted to move outwardly into the pair of collar openings, and a pair of laterally spaced openings each on one side of a bent portion through which a tab of the pair of tabs may pass. Upon bending of the tabs over the inner surfaces of the bent portions, the bow springs are secured in an even more permanent fashion due to the presence of a pair of tabs which extend through the openings in the bow springs.

In the illustrated embodiment of the invention, the tabs are formed on adjacent sides of each pair of collar openings, and the pair of openings in the end of each collar are on adjacent sides of the pair of bent portions so that the tabs of each pair are bent away from one another. Also, each collar has outwardly recessed portions in which the openings are formed and of a size to receive the end of the bow spring with its inner surface and the inner surfaces of the tabs substantially flush with the inner surfaces of the collar on opposite sides of the recessed portions. Thus, the collars are assembled about the casing in a more stable fashion due to the fact that substantially their entire inner surfaces are engaged therewith.

In the drawings, wherein like reference characters are used throughout to designate like parts:

Figure 1:
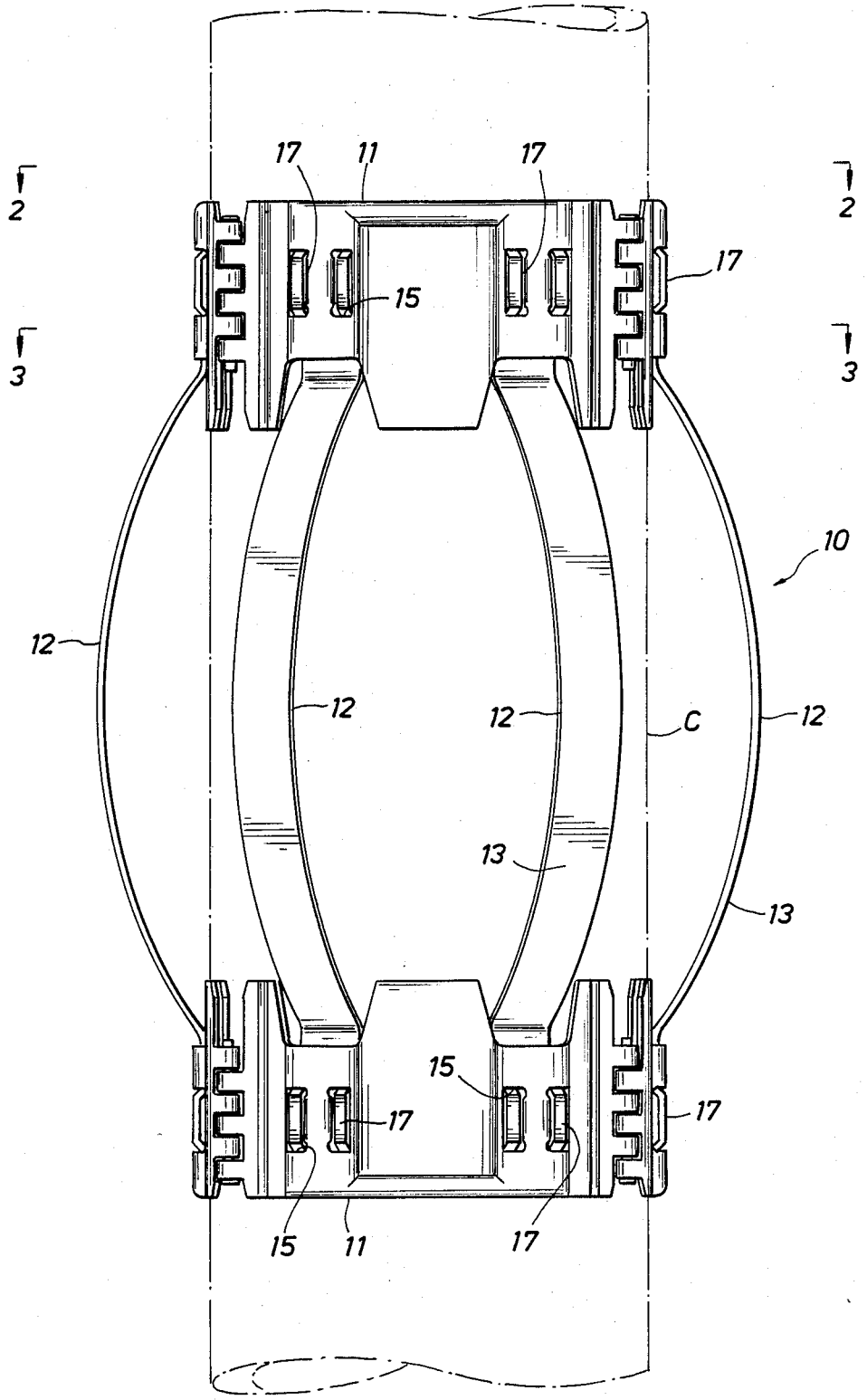
FIG. 1 is a side elevational view of a centralizer constructed in accordance with the present invention and disposed about a casing which is shown in phantom lines.
Figure 2:
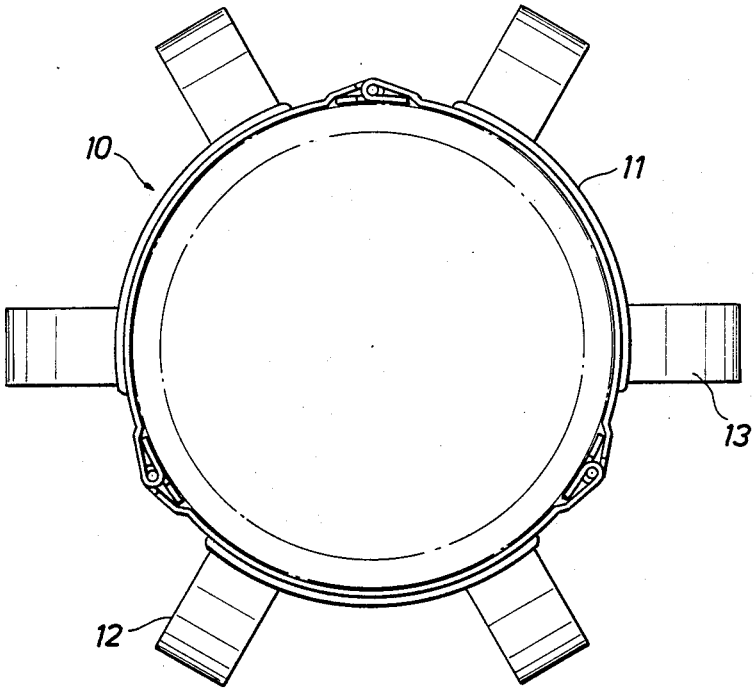
FIG. 2 is a top plan view of the centralizer, as seen along broken lines 2—2 of FIG. 1.
Figure 3:
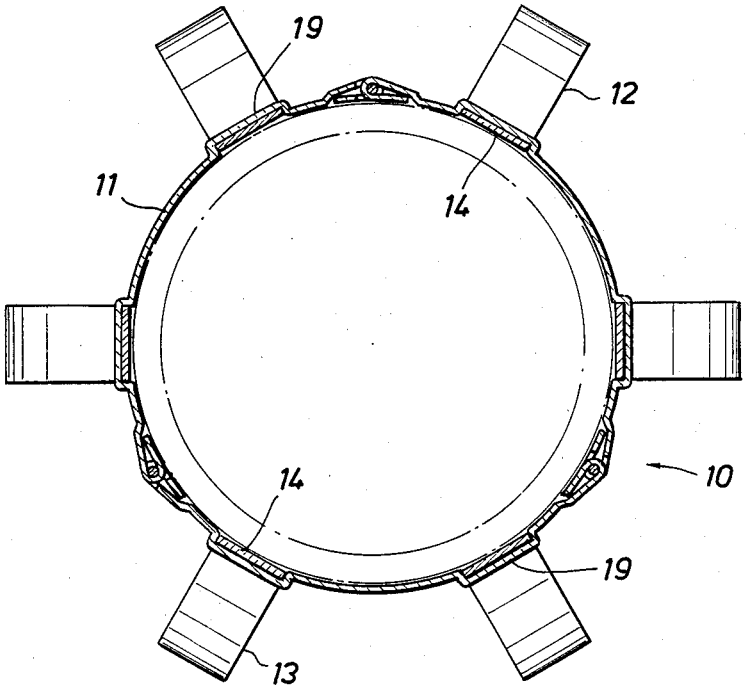
FIG. 3 is a cross-sectional view of the centralizer, as seen along broken lines 3—3 of FIG. 1.
Figure 4:
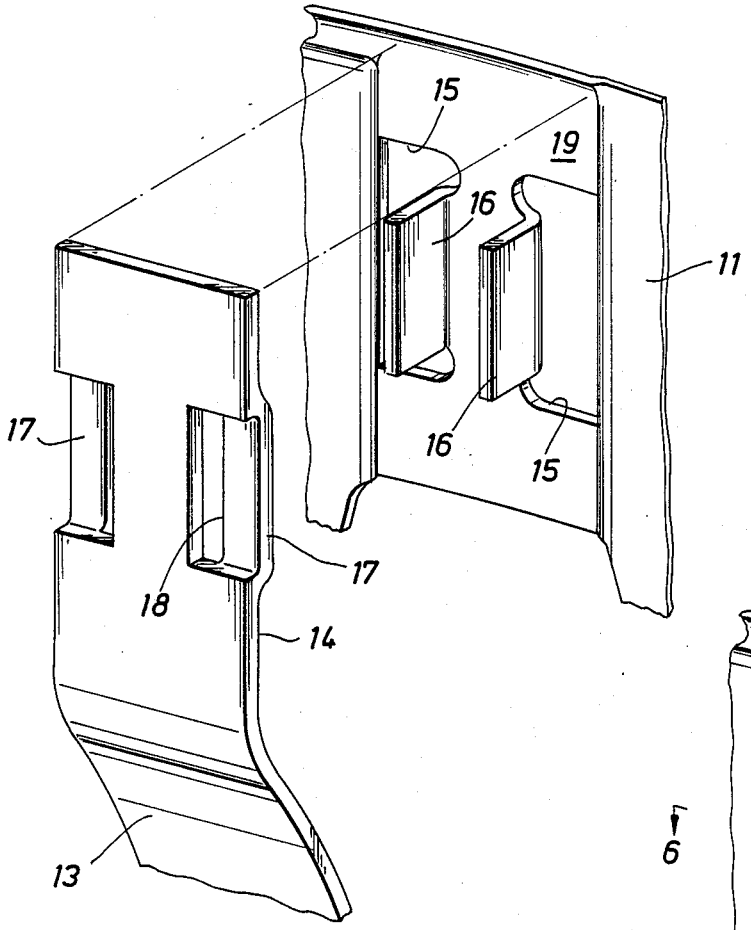
Figure 5:
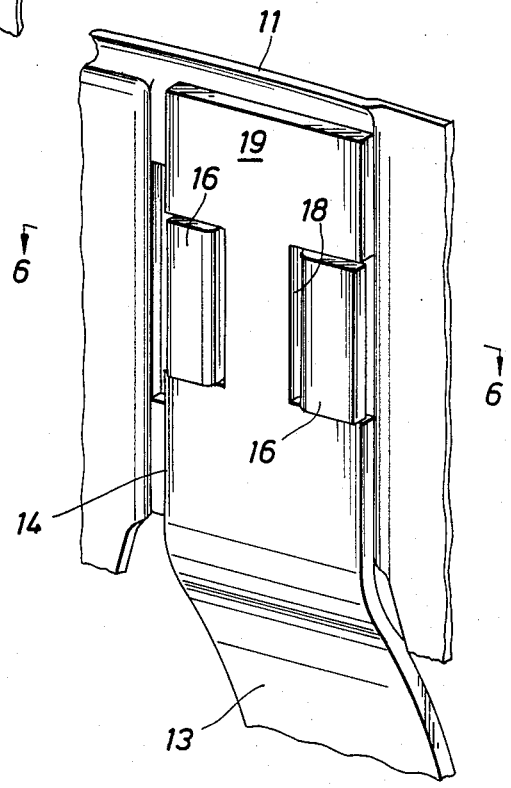
Figure 6:
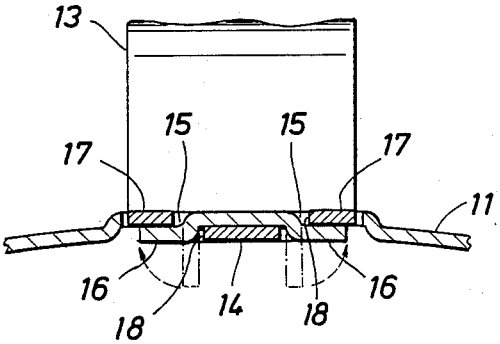

FIG. 4 is an exploded, perspective view of one end of a bow spring and a portion of a collar, on an enlarged scale, and as seen from the inner surfaces of both, the end of the bow spring being located for movement outwardly against the inner surface of the collar to dispose its outwardly bent portions into the openings in the collar and to permit the tabs on the collar to pass through openings on the sides of the bent portions;

FIG. 5 is another perspective view of the end of the bow spring and inner surface of the collar, similar to FIG. 4, but upon movement of the end of the bow spring against the inner surface of the collar and bending of the tabs against the inner surfaces of the outwardly bent portions of the end of the bow spring; and FIG. 6 is a cross-sectional view of the end of the bow spring and portion of the collar, as seen along broken lines 6—6 of FIG. 5.

With reference now to the details of the above described drawings, the overall centralizer, indicated in its entirety by reference character 10, is shown to comprise a pair of longitudinally spaced collars 11 assembled about the casing C and bow springs 12 extending longitudinally between the collars. As previously described, each collar is made up of hingedly connected arcuate sections, in this case three, adapted to be wrapped around the casing and then suitably latched to one another by hinge pins, all as well known in the art. Each bow spring 12 includes an outwardly bowed portion 13 intermediate its ends 14 which are secured to the collars in a manner to be described to follow.

Each collar has the ends of two bow springs secured thereto and thus two spaced pairs of laterally spaced openings 15 formed there, with the pairs of openings being so arranged that, upon assembly of the collars about the casing, the pairs of openings are generally equally circumferentially spaced apart from one another, thus enabling the bow springs to be equally circumferentially spaced apart about the centralizer when secured to the collars. As previously described and shown in the drawings, a tab 16 extends inwardly from a side of each opening, with the tab being formed integrally with the collar, upon cutting along three sides of the openings 15, to permit them to be bent back along the uncut edge of the opening. As best shown in FIG. 4, the openings are also formed by the cutting of slots at their upper and lower ends, and thus above and below each tab, whereby the tab is of lesser height than the opening. As shown, the longitudinal cut forming the opening is made along its outer side and the tabs are bent inwardly and toward one another from adjacent inner sides of the openings.

The end of each bow spring is provided with a pair of laterally spaced outwardly bent portions 17 each of which is of a size to fit closely within an opening 15 of the pair of openings as the end of the bow spring is moved outwardly toward the inner surface of the collar. More particularly, laterally spaced openings 18 formed in each end of the bow spring adjacent the adjacent inner sides of the outwardly bent portion 17 are of such size as to permit the inwardly bent tabs 16 to pass through them as the outwardly bent portions 17 move into the collar openings 15.

With the outwardly bent portions disposed within the openings 15, and the tabs 16 extending through the openings 18 in the ends of the bow springs, the tabs are bent outwardly or away from one another and thus across the inner surfaces of the outwardly bent portions so as to hold the outer surfaces of the ends of the bow springs against the inner surfaces of the collar. When the collars are assembled about the casing, the close fit of the inner surfaces of the outwardly bent tabs about the casing will normally retain the outwardly bent portion 17 within the openings 15 and thus prevent the ends of the bow springs from being pulled loose from the collars. However, as previously described, even if the bent portions are forced out of the collar openings, the tabs prevent the bow springs from being pulled loose from the collars.

Preferably, the openings 15 are formed in outwardly recessed portions 19 of the collars which are of a width to receive the ends of the bow springs. More particularly, the outwardly recessed portions enable the inner surfaces of the bow springs to be disposed substantially flush with the inner surfaces of the collar on opposite sides of the outwardly recessed portions. With the collars and ends of the bow springs being of substantially the same thickness, the outwardly bent tabs are also substantially flush with the inner surfaces of the ends of the bow springs and the collars, thus permitting substantially full contact of the ends of the centralizer with the casing, thus maintaining a firm mounting of the centralizer about the casing. Additionally, the upper end of the upper end edge of the upper collar and the lower end edge of the lower collar are bent inwardly to provide circumferential edges engagable with the casing.

As in other centralizers of this type, the centralizer 10 may be stored and shipped in unassembled condition, and then assembled about the casing in the field. Since the collars and bow springs may be stacked, they occupy a minimum of space during shipment as well as storage. Also, since they need not be assembled, they may be stacked in a wide variety of sizes of collars and bow spring.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A casing centralizer, comprising a pair of longitudinally spaced collars adapted to be assembled about a casing, and bow springs extending longitudinally between the collars, each collar having openings formed therein and a tab on one side of each opening which is extendible inwardly from the inner surface of the collar, each bow spring having an outwardly bent portion at each end thereof adapted to fit within one of said collar openings and an opening therein on one side of the bent portion through which the tab may pass, and said tab being bendable over the inner surface of the bent portion so as to hold the outer surface of the end of the bow spring against the inner surface of the collar.

2. A casing centralizer of the character defined in claim 1, wherein each collar has outwardly recessed portions in which the collar openings are formed and of a size to receive the end of the bow spring with its inner surface and the inner surfaces of the tabs substantially flush with the inner surfaces of the collar on opposite sides of the recessed portions.

3. A casing centralizer comprising a pair of longitudinally spaced collars adapted to be assembled about a casing, and bow springs extending longitudinally between the collars, each collar having pairs of laterally spaced openings formed therein and a tab on the side of each opening which is extendible inwardly from the inner surface of the collar, and each bow spring having a pair of laterally spaced outwardly bent portions at each end thereof adapted to move outwardly into one of said pairs of collar openings and a pair of laterally spaced openings therein each on one side of each bent portion through which a tab of the pair of tabs may pass, and said tabs being bendable over the inner surface of the bent portions so as to hold the outer surfaces of the end of the bow springs adjacent the inner surfaces of the collars.

4. A casing centralizer of the character defined in claims 3, wherein the bendable tabs are formed on adjacent sides of each pair of collar openings, and the pair of openings in the end of each collar are on adjacent sides of the pair of bent portions so that the tabs of each pair are bent away from one another.

5. A casing centralizer of the character defined in claim 3, wherein each collar has outwardly recessed portions in which the collar openings are formed and of a size to receive the end of the bow spring with its inner surface and the inner surfaces of the tabs substantially flush with the inner surfaces of the collar on opposite sides of the recessed portions.

* * * * *